US008800441B2

(12) United States Patent
Clarke

(10) Patent No.: US 8,800,441 B2
(45) Date of Patent: Aug. 12, 2014

(54) SQUEEGEE BLADE FOR SCREEN PRINTING AND METHODS OF MANUFACTURE AND USE OF SAME

(76) Inventor: Joe Clarke, St. Charles, IL (US)

( * ) Notice: Subject to any disclaimer, the term of this patent is extended or adjusted under 35 U.S.C. 154(b) by 232 days.

(21) Appl. No.: 13/488,279

(22) Filed: Jun. 4, 2012

(65) Prior Publication Data

US 2013/0139711 A1 Jun. 6, 2013

Related U.S. Application Data

(63) Continuation-in-part of application No. PCT/US2010/037543, filed on Jun. 4, 2010.

(51) Int. Cl.

| | |
|---|---|
| ***B05C 17/04*** | (2006.01) |
| ***B05C 3/02*** | (2006.01) |
| ***B05D 3/12*** | (2006.01) |

(52) U.S. Cl.

USPC ..... 101/123; 101/124; 118/413; 427/357

(58) Field of Classification Search

CPC ..... B41F 15/0818; B41F 15/0827; B41F 15/085; B41F 15/0854; B05C 11/02; B05C 11/04; B05C 11/041; B05C 11/042; B05C 11/045; B05C 11/048

USPC ..... 101/119, 120, 123, 124, 129, 157, 169; 118/413; 427/356, 357; 15/256.5, 15/256.51, 256.53

See application file for complete search history.

(56) References Cited

U.S. PATENT DOCUMENTS

| | | | | |
|---|---|---|---|---|
| 5,027,703 | A * | 7/1991 | Hancy | 101/123 |
| 5,448,948 | A * | 9/1995 | Somers et al. | 101/123 |
| 5,775,219 | A * | 7/1998 | Shimazu et al. | 101/123 |
| 6,047,636 | A * | 4/2000 | Newman | 101/129 |
| 6,355,055 | B1 * | 3/2002 | Waksman et al. | 623/1.13 |
| 2010/0242754 | A1 * | 9/2010 | Nishi et al. | 101/123 |

* cited by examiner

*Primary Examiner* — Ren Yan

(74) *Attorney, Agent, or Firm* — Law Offices of Mark A. Hamill, P.C.

(57) ABSTRACT

The present invention is directed to improved screen printing squeegee blades, which include a first end, a second end, a top portion for receipt by a blade holder, a bottom portion adapted for contacting the screen of a screen printing press along at least one printing edge, a front face, a back surface, and a buckle control channel formed in either the front face or the back surface.

21 Claims, 8 Drawing Sheets

SQUEEGEE BLADE FOR SCREEN PRINTING AND METHODS OF MANUFACTURE AND USE OF SAME

FIELD OF THE INVENTION

The present invention is directed to improved squeegee blades for use in commercial screen printing presses, as well as methods for manufacturing such blades and printing with such blades. More particularly, the invention is directed to a squeegee blade which includes a buckle control channel formed in the blade to provide consistent, regulated squeegee blade buckling along the blade length, as well as methods of manufacturing and processes for printing utilizing such improved blades.

BACKGROUND OF THE INVENTION

There are currently a variety of squeegee blades utilized in screen printing presses to induce ink to travel through a mesh screen onto a substrate to receive the ink. Conventional squeegee blades have proven to be less than adequate when utilized under conventional press set up parameters, which typically include relatively high downward force on the blade holder and less than optimal blade speeds for a given ink and printed image size. When printers attempt to run conventional blades in a screen printing press at significantly higher than conventional blade holder speeds, the result is typically degraded print quality on the printed substrate. One prior method printers have often utilized to attempt to improve squeegee speed and thereby screen printing efficiency has been to increase the downward pressure on the squeegee blade holder beyond conventional parameters. While, under certain very limited conditions, increased blade holder pressure can result in increased print speed and productivity, it more frequently results in degraded print quality and ink build up, which can increase press maintenance costs. Further, increasing downward pressure on the blade holder often leads to unacceptably high screen tearing rates and can further result in excessive wear on the squeegee blade, the screen and other printing press components. Still further, even when a screen printing press is set up with conventional blade holder downward forces and run at conventional speed, conventional blades are believed by the applicant to be less abrasion resistant and chemically stable than is optimal.

Furthermore, prior art squeegee blades often print a wavy ink film onto the substrate. In other words, the printed ink film deposited on the substrate frequently had an uneven, inconsistent thickness in both the y-axis and x-axis relative to the screen mesh. Moreover, both printing edges of the prior art squeegee blades tended to print similarly wavy ink films with similarly average thicknesses. For certain precision screen printing applications, such as printing high quality graphic design materials and printing membrane switches, the printing of consistent ink film thickness is of considerable importance. With conventional prior art squeegee blades, the best approach to attempting to print with a consistent film thicknesses was to slow print speeds far below optimal press throughput and, even then, significant numbers of the printed materials had to be rejected for failure to meet ink thickness or pin hole quality control standards.

U.S. Pat. No. 5,027,703 illustrates three examples of prior art squeegee blade design for use in manual screen printing presses. The first design, shown in FIG. 2, illustrates the most commonly used conventional rectangular blade. FIGS. 3-8 and FIGS. 9-10 of the '703 patent illustrate an internal profile and external profile squeegee blades, in which a cavity is located within the blade about ⅛ of an inch above the printing edge of the blade in order to allow a measured volume of ink to fill the cavity during a print stroke. None of the three styles of blades illustrated in the '703 patent are believed to overcome the printing efficiency, durability, film consistency, pin hole and chemical resistance issues of prior art squeegee blades.

SUMMARY OF THE INVENTION

In one aspect of the invention, an improved screen printing squeegee blade is provided which includes a blade body having a first end, a second end, a top portion for receipt by a blade holder, a bottom portion adapted for contacting the screen of a screen printing press along at least one printing edge, a front face, a back surface, and a buckle control channel formed in one of the front face and the back surface. In another aspect of the invention, the buckle control channel includes at least one channel side wall, a channel bottom portion, and an accurate channel transition portion extending between the channel side wall and channel bottom portion. In another aspect of the invention, the buckle control channel provides a substantially uniform buckling zone along the length of the squeegee blade from the first end to the second end to provide controlled buckling of the blade adjacent to at least one printing edge of the squeegee blade during a print stroke. When screen printing with prior art squeegee blade designs made with resilient materials harder than the conventional soft squeegee blades with a 55 Shore A hardness, such hard conventional blades typically hinge near the blade holder during the print stroke. Such hinging greatly reduces print quality. Soft conventional blades, on the other hand, typically hinge in an uncontrolled manner result in excess interface area between the mesh and blade, which can cause ink piling, dot gain, or mottling. The controlled squeegee blade buckling properties offered by the improved squeegee blades of the present invention are believed to allow the use of significantly harder plastic resins, e.g. Shore A hardness of significantly greater than about 65, compared to typical conventional blades with Shore A hardness of less than about 55. The use of such harder resin materials provides the blade with significantly improved abrasion resistance and chemical stability. In another aspect of the invention, the improved screen printing squeegee blade includes at least one substantially perpendicular print edge defining a first transition between the bottom portion and either the front face or the back surface of the improved squeegee blade and further includes a second print edge, which defines a substantially beveled transition between the bottom portion and the back surface of the improved squeegee blade. In another aspect of the invention, the buckle control channel extends substantially linearly from the first end to the second end of the squeegee blade and may be located in the bottom portion of the squeegee blade.

While it is theoretically possible to print material on a screen press that has a screen that is far larger than the substrate upon which ink is to be printed, in the real world of commercial printing, this infrequently occurs. The reason for this is that the smaller the dimensions of a print screen and the press utilized for any given job, the more economically the printing press is typically for a printer to purchase and operate. Accordingly, most presses are utilized to print on substrates where the edges of the printed image will be located close enough to the periphery of the screen that it is necessary to use a squeegee blade nearly as wide as the screen frame. The higher screen printing tension at edges of screen mesh adjacent to the frame cause uneven buckling (or blade bowing) wherein the center portion of the blade buckles less than the edges causing it to bow outward in the y-axis (print stroke axis) relative to the two ends of the squeegee blade during a print stroke. In such prior conventional blades, in order to cause the center portion of the blade to buckle sufficiently to produce printed material of acceptable quality, the downward pressure on the blade holder had to be set high enough to cause the central portion of the blade to buckle when making contact with the low screen tension central portion of the screen. To accommodate such uneven screen printing tension and prevent uneven squeegee blade buckling, in another aspect of the invention, an improved screen printing squeegee blade is provided wherein the buckle control channel is curved along its length to accommodate differential screen printing tension typically found across commercial printing press screens from the center portion to the peripheral edge near the press frame. The curved buckle control channel assists in maintaining the print edge of the squeegee blade in a substantially linear shape along its x-axis throughout a print stroke.

In another preferred aspect of the invention, the curved buckle control channel defines a channel formed in the front face of the squeegee blade, which extends from the first end to the second end of the blade in a parabolic arc with the channel extending closer to the bottom of the blade in its center portion than at its first and second edges. In another preferred aspect of the invention, the parabolic path of the channel ranges from about ½ the distance between the top and bottom edges of the front face of the blade and extends to each of the first end and second end at about ¼ of the distance between the top and bottom edges in the center portion of the blade. In another aspect of the invention, the channel is formed by cutting a pair of elongated radially overlapping cylindrical shaped channels into the front face of the blade. In accordance with one aspect of the invention, the curved buckle control channel is adapted to accommodate screen printing tension differentials between the center portions of the screen and the edges adjacent the frame of between about 80 and 20 N/cm$^2$. In one preferred embodiment of the invention, the channel is about 70% wider at both the first end and the second end of the squeegee blade than at the narrower center portion of the channel in the center of the blade.

In another preferred aspect of the invention, the improved squeegee blade is formed from a di-isocyanate polyurethane resin with a Shore A hardness of greater than about 65. In one preferred embodiment of the invention, the improved squeegee blade is molded from Methylene di-isocyanate resin which has a Shore A hardness of about 85. The provision of a buckle control channel is believed to allow the improved squeegee blades of the present invention to be formed from significantly harder materials than would otherwise be feasible to utilize for efficient screen printing. With prior art blade designs, blade manufactured with resins having a Shore A hardness of greater than about 65 typically have lead to unacceptable high screen rip rates and/or less than desirable print quality due to blade hinging during print runs. For this reason, they have been generally avoided in favor of blades having a Shore A hardness of between 45 and 60. Accordingly, it is one object of the present invention to provide improved blades squeegee designs that can be made from significantly harder materials than have hereto been feasible for efficient screen printing. It has been found that the blades of the present invention can produce high quality, high speed print runs without excessive screen ripping.

The present inventor has further discovered that the improved squeegee blade designs of the invention can allow a screen printing press to be set up with significantly lower downward pressure on the squeegee blade, which allows the press to operate at significantly higher print speeds. Those lower downward pressure parameters also provide the benefit of decreasing wear on the squeegee blade, the screen mesh, stencil (if one is called for in a particular print job) and other screen printing press components. Accordingly, in accordance with another aspect of the invention, an improved method of screen printing is provided including the steps of: providing a screen printing press which includes an improved squeegee blade having a buckle control channel formed in one of the front face and the back surface of the blade; setting the printing press to provide a downward squeegee blade pressure of less than about 40 N/cm$^2$, loading a substrate and ink into the screen printing press, spreading ink onto the screen above the substrate, and causing the ink to be printed onto the substrate by moving the squeegee blade across the screen in contact with the spread ink and screen mesh thereby forcing the ink through the mesh and onto the substrate. In one preferred method of the invention, the process of setting up the printing press includes the further step of setting the initial blade angle on the improved squeegee blade such that the blade face is substantially perpendicular to the screen of the printing press. In another aspect of the methods of the invention, the initial blade angle of the improved squeegee blade is set such that the blade face is positioned to be less than about 7 degrees from perpendicular with the printing press screen, and preferably between 3 and 5 degrees from perpendicular. In another aspect of the methods of the invention, the printing press is set up to print with a squeegee blade speeds of greater than 10 (ten) inches per second and preferably from 15 to 25 inches per second to print on a clothing substrate, such as a T-shirt. In another aspect of the methods of the invention, the squeegee blade buckles along the length of channel in a manner which maintains a substantially linear printing edge on the squeegee blade along its length in the in the print stroke axis (y-axis) throughout a print stroke.

In a further preferred aspect of the invention, the applicant has developed at least five different blade print edge/curved buckle control channel configurations, which yield different printed ink film thicknesses on a substrate for each of the two printing edges of the blade. Furthermore, applicant has found that it is often advantageous for the printer to have each of the two printing edges on a single blade provide significantly different, but consistent ink film thicknesses in order to allow the printer the flexibility to select a specific print edge of one of the five blade iteration to match a precision printing specification for an ink film thicknesses. One of these additional iterations of blades includes a curved buckle control channel on the front face with two perpendicular print edges at both the transition from the front face to bottom surface and the back surface to bottom surface of the blade. Such a blade can be set up for precision printing to provide ink film thicknesses of between about 0.55 to about 0.70 thousandths for the front face print edge and between about 0.75 to about 0.85 thousandths on the back side print edge. The press set up parameters can be varied slightly to give different thicknesses within the ranges set forth herein, but it should Another of the such combinations includes a blade with a curved buckle control channel on its front face, a first perpendicular print edge at the transition from the front face to the bottom surface of the blade, and a second beveled print edge at the transition between the beveled portion of the back surface and the blade bottom surface. The first perpendicular printing edge of such a blade provides a substrate film thickness of between about 0.55 to 0.65 thousandths of an inch, and the second beveled print edge provides an ink film thickness of about 0.85 to about 0.95 thousandths of an inch. A third additional blade combination includes a curved buckle control channel on the front face of the blade with a first, beveled printing edge defining the transition between a beveled portion of the front face and the bottom surface of the blade and with a second, perpendicular printing edge defining the transition between the back surface and the bottom surface of the blade. The first beveled printing edge of the third blade iteration provides a substrate film thickness of about 0.75 to about 0.85 thousandths of an inch, and the second perpendicular beveled print edge provides an ink film thickness of about 0.55 to about 0.65 thousandths of an inch. A fourth iteration of the blades of the invention includes a curved buckle control channel on the front face of the blade with a first, beveled printing edge defining the transition between a beveled portion of the front face and the bottom surface of the blade and with a second, beveled printing edge defining the transition between the back surface and the bottom surface of the blade. The first beveled printing edge of the fourth blade provides a substrate film thickness of about 1.05 to about 1.15 thousandths of an inch, and the second perpendicular beveled print edge provides an ink film thickness of about 0.95 to about 1.05 thousandths of an inch. A fifth iteration of the blades of the invention includes a curved buckle control channel on the front face of the blade, a substantially linear smaller diameter buckle control channel on the back surface adjacent to the bottom surface of the blade with a first, perpendicular printing edge defining the transition between the front face and the bottom surface of the blade and with a second, perpendicular printing edge defining the transition between the back surface and the bottom surface of the blade. The first beveled printing edge of the fifth blade provides a substrate film thickness between about 0.65 to about 0.75 thousandths of an inch, and the second perpendicular print edge provides an ink film thickness of between about 1.25 and about 1.35 thousandths of an inch.

DETAILED DESCRIPTION

Figure 1:
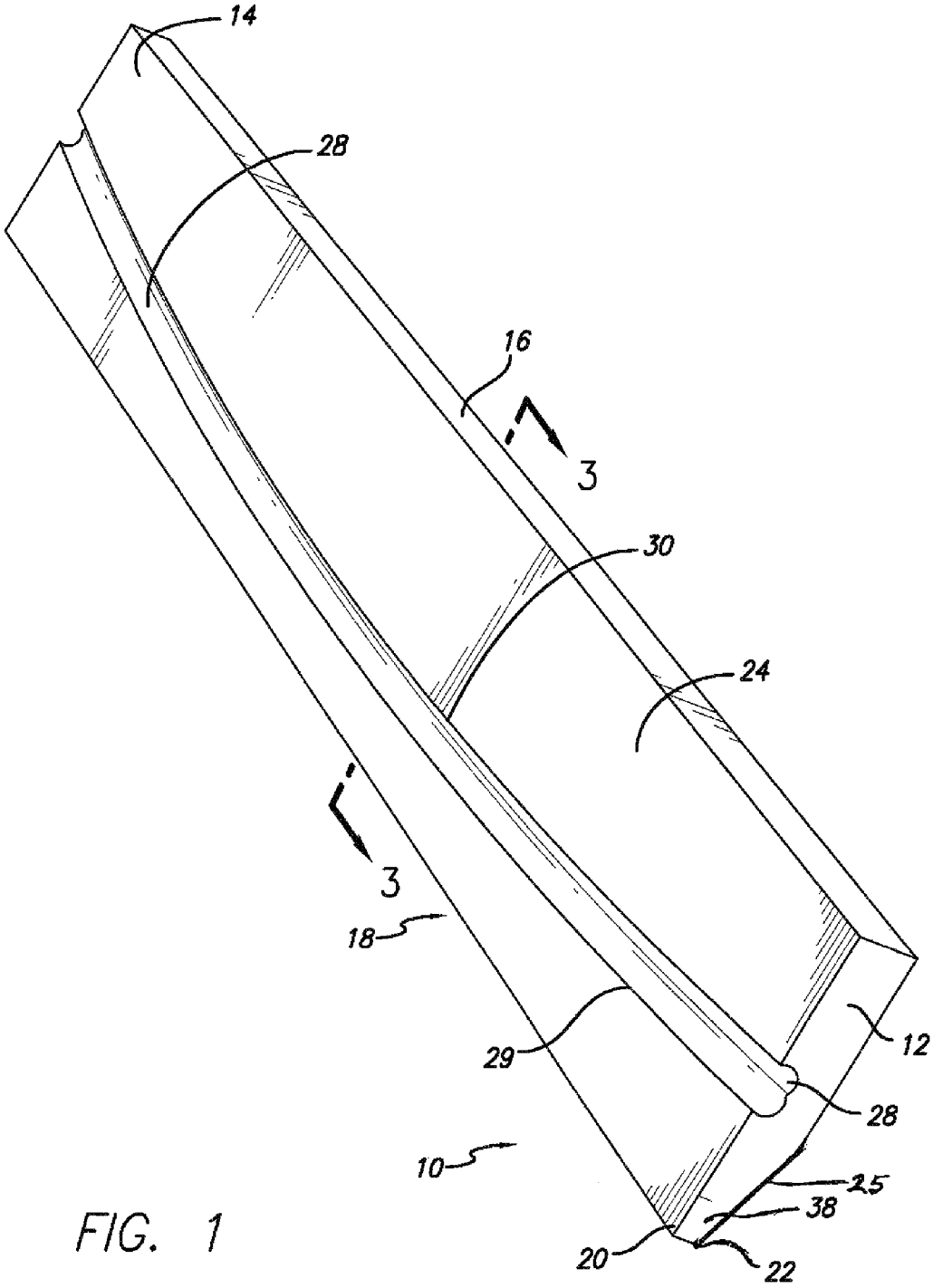
FIG. 1 is a front perspective view of a squeegee blade in accordance with one embodiment of the invention.
Figure 2:
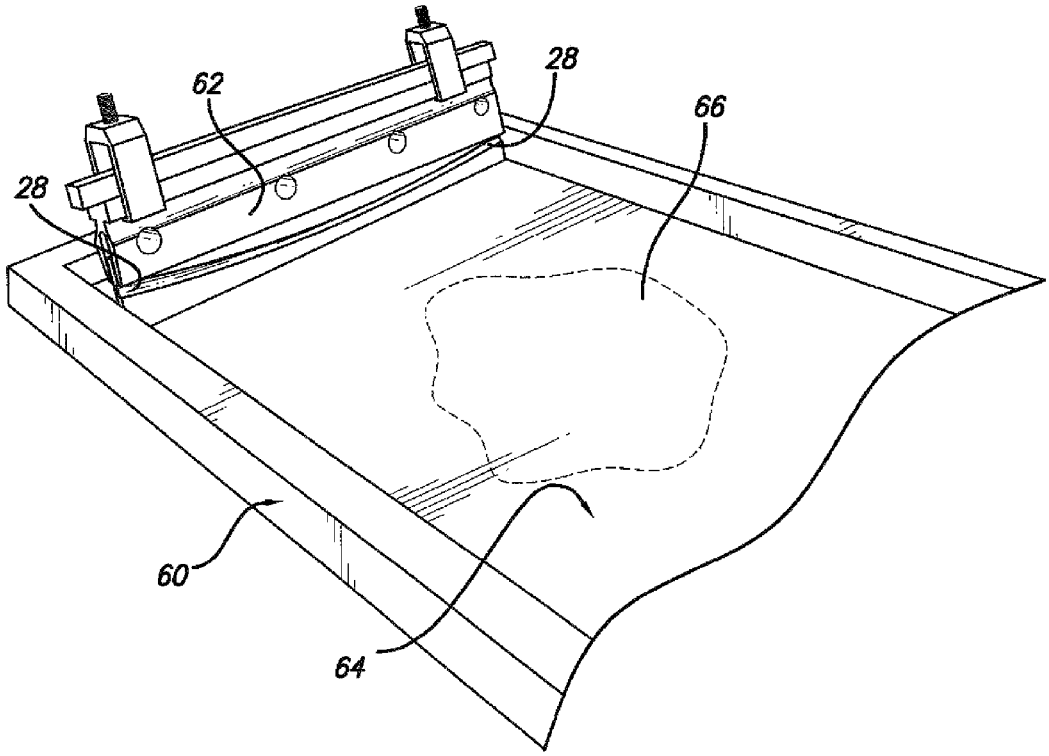
FIG. 2 is a prospective view of the squeegee blade of FIG. 1 mounted in a commercial screen printing press.

As illustrated in FIGS. 1-6, a first embodiment of an improved squeegee blade 10 of the invention is provided, which includes, a first end 12, a second end 14, a top surface 16 for receipt by a blade holder 62, a bottom surface 18, a front face 24, and a back surface 26, a first printing edge 20 joining the front face 24 and bottom surface 18, a second print edge 22 joining the bottom surface 18 and back surface 26, bull nose corner portions at the ends of the bottom surface 18, and a buckle control channel 28 formed in the front face 24. Both printing edges 20 and 22 are adapted for contacting the screen 64 of a screen printing press 60 (see FIG. 2). The squeegee blade 10 is generally an elongated rectangular in shape with the exception of the beveled surface 25 printing edge 22, bull nose corner portions 38, and the buckle control channel 28.

Figure 3:
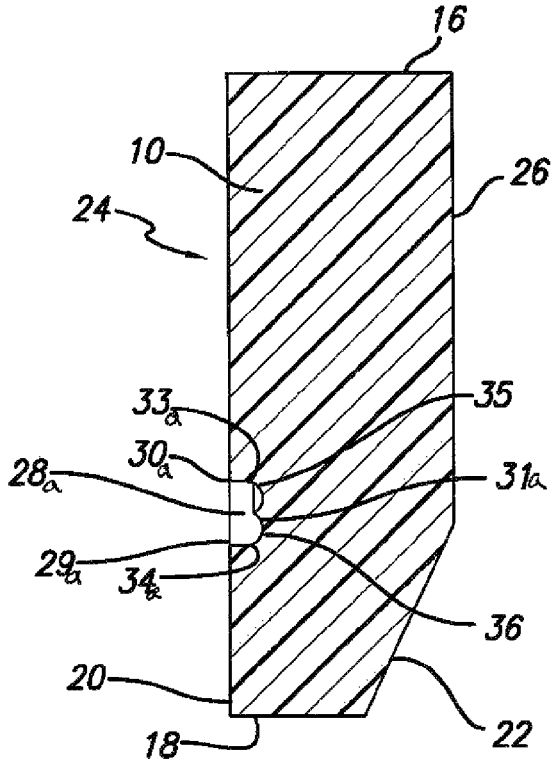
FIG. 3 is an enlarged, cross-sectional view taken along lines 5-5 of FIG. 1.
Figure 4:
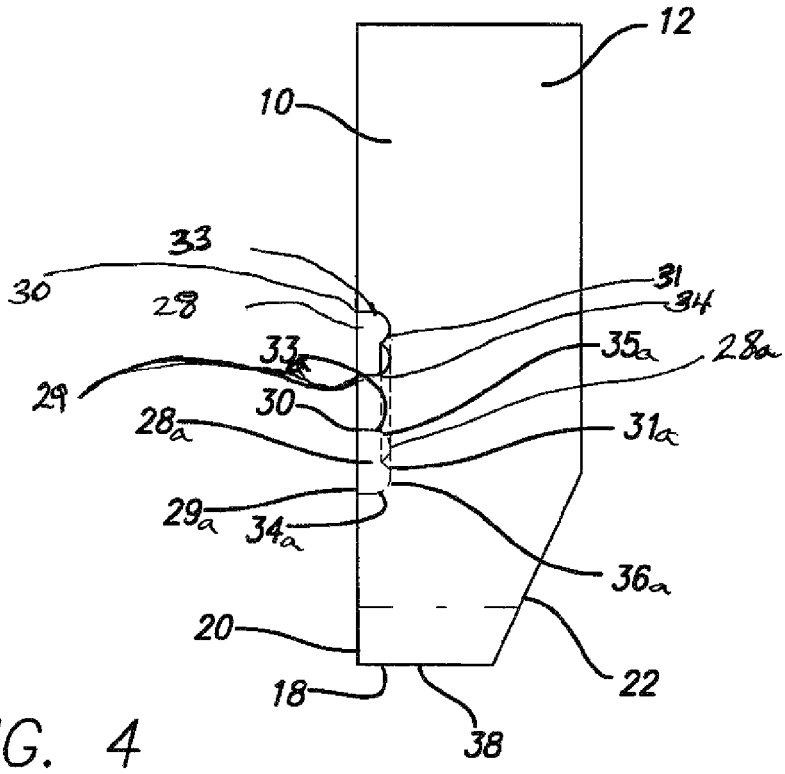
FIG. 4 is an enlarged, end plan view of the squeegee blade of FIG. 1.
Figure 5:
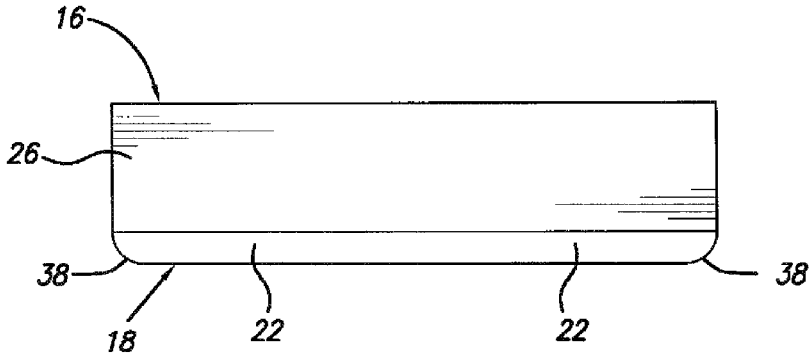
FIG. 5 is a rear plan view of the squeegee blade of FIG. 1.

Turning to the details of the squeegee blade 10, blades of this design have proven to significantly increase the efficiency of the T-shirt printing in automatic screen printing presses. The dimensions of blade 10 are as follows: the blade 10 is 16 inches long as measured from the first end 12 to the second end 14, the height of the blade 10 taken between is top surface 16 and bottom surface 18 is about 2 inches along its front face 24, the thickness of the blade 10 is ⅜ of an inch as measured between front face 24 and back surface 26 along top surface 16. The bottom edge 39 of the buckle control channel 28 is preferably located about 11/32 of an inch from the first printing edge 20 in the central portion of the blade 10 and about ¾ of an inch at ends 12, 14. As best seen in FIGS. 3-5, the second printing edge 22 is defined by beveled surface 25, which is beveled at an angle of between about 22° and 30° from the back surface 26. Referring now to FIGS. 3-4, the width of the buckle control channel 28 at both first end 12 and second end 14 as measured between channel bottom edge 29 and channel top edge 30 is 11/32 of an inch. The buckle control channel 28 narrows to measure 7/32 of an inch between channel bottom edge 29 and channel top edge 30 at the center of the blade 10. The curvature of the buckle control channel is depicted by the dashed or "phantom" lines **28*a* in FIGS. 4 and 12 and solid lines in the cross-sectional view of FIG. 3. The buckle control panel further includes channel side walls 33 and 34, a channel bottom portion 31, and accurate channel transition portions 35, 36 extending between the channel side walls 33, 34, respectively, as well as channel bottom portion 31 (the central portion of the buckle control channel shown in dashed lines and with corresponding letter "a, that is, 28*a*-33*a* in the end plan view of FIG. 4). The depth of the buckle control channel 28 is approximately one half of the thickness of the blade or about 3/16 of an inch measured between the channel bottom portion 31 and channel edges 29, 30. The radius of curvature of the buckle control channel 28 of blade 10 varies along its length from about 65 inches near the central portion of the blade 10 to about 24 inches along the peripheral portions of the buckle control channel 28 adjacent to first end 12 and second end 14. Squeegee blades of about 16 inch length, such as blade 10, are commonly utilized in automatic screen printing presses adapted for T-shirt printing. However, where a screen printing press has a dimension smaller than 16 inches, such as, for example, in some graphics printing jobs or printing children's T-shirts, the blade 10 can be trimmed an equal amount on both ends to maintain the appropriate curvature of the buckle control channel across the trimmed blade. In most instances the printer will select a squeegee blade that is from 1 inch to 2 inches larger than the printed image width and choose to use a printing press that is 1 inch to 2 inches wider than the squeegee blade selected. The shape of the buckle control channel 28 has been designed to, and has proven in actual use, to be adept at accommodating the variation in tension across the screen mesh of a screen printing press. Those variations typically range from about 30N/cm$^2$ to about 80 N/cm$^2$ between the central portion of the mesh and the areas adjacent to the frame along the length of the screen. In the corner areas of the screen the mesh tension is frequently much higher still in the range of about 50 N/cm$^2$ to about 150 N/cm$^2$. For this reason, the blade 10** has been designed to accommodate variations in screen tension as high as a ratio of 8 to 1 between the peripheral corners of the screen and its central portion. Due to the high cost of acquiring and operating large sized screen printing presses, most commercial screen printers print "oversized images on undersized print screen frames" relative to truly optimal printing conditions. As discussed above, this means that there is a significant pressure differential between the center portion of the screen and the peripheral areas of the screen near the press frame. The tension differential in the screen is largely confined to the outer 5 inches of the screen along the frame. In a perfect world, printers would avoid utilizing the outer 5 inches of the peripheral portion of the screen for printing images to avoid the printing problems caused by the tension differential tension across the screen. However, this would limit an 18 inch wide press to printing images with a maximum width of 8 inches, which is commercially unrealistic.

For these reasons, the automatic screen printing presses typically utilized for printing of T-shirts, the distance between the two ends 12, 14 of the blade 10 and the inside of the frame can be as small as 1 inch, in which case the ratio between the highest tension from near the blade ends and the lowest tension found in the center of the screen is about 4 to 1. Where a smaller squeegee blade is used relative to the size of the print screen frame, such as, where 16 inch blade is used in a 20 inch wide screen press, the distance between the inside the frame and in the blade ends would be about 2 inches. Under those conditions, the tension ratio between the areas of the mesh two inches from the frame and the central portion of the mesh would typically be between 2 to 1 to 4 to 1. The dimensions of the buckle control channel 28 has been empirically selected to allow buckling of the blade 10 adjacent to the printing edges 20, 22 of the improved blade 10 along its length to overcome the tension differentials that range from about 2 to 1 to about 8 to 1. These ranges are of tension ratios are those which are typically found in automated commercial screening printing presses utilized for T-shirt printing and also for graphic design print work.

Figure 6:
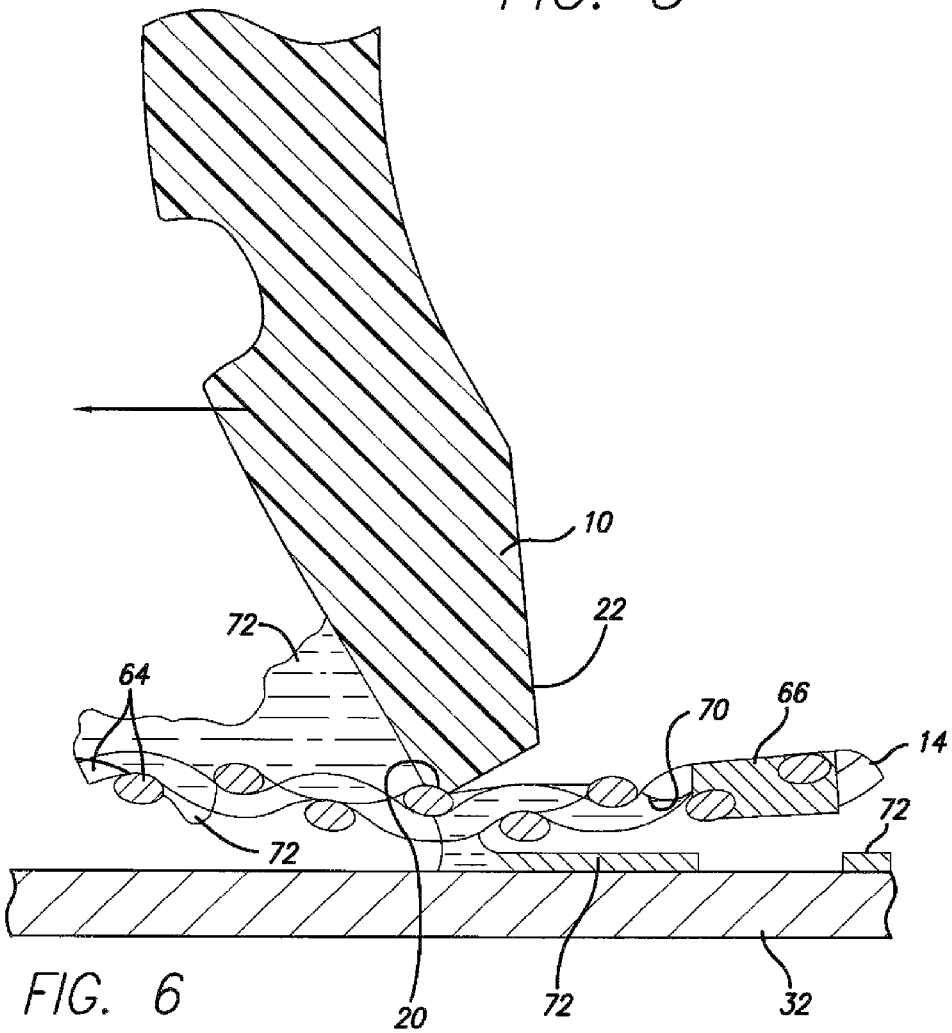
FIG. 6 is an enlarged, cross-sectional view showing the arrangement of the squeegee blade, screen mesh, stencil, ink, and substrate.

Referring now to FIG. 6, the squeegee blade 10 is shown during an active print stroke. In order to print efficiently, the blade 10 first needs to cause the ink 72 to travel through the screen fabric 64. Then, in addition, the squeegee 10 pushes the screen fabric 64 into contact with the substrate 32 and forms a temporary seal with the stencil 66. As can be seen in FIG. 6, a stencil 66 adhered to the screen fabric 64 defines the area where the ink 72 cannot flow throw the screen fabric 64. As the squeegee 10 moves over the screen fabric 64, and thereby deflecting the screen fabric 64, the portion of the screen fabric behind the squeegee 10 snaps upward away from the substrate 32, which further assist in drawing the ink 62 through the orifices 70 and onto the substrate 32. FIG. 6 shows the screen fabric 64 exaggeratedly spaced from the substrate 32 in order to show the elements. A squeegee cannot successfully travel any faster than the time it takes the ink to first travel through the small orifices of the screen fabric, past the bottom of the stencil 66, adhere to the substrate 32, and shear (pull) the ink 72 out of the orifices due to the pressure differential created by the temporary seal and the action of the screen fabric snapping upward after the blade moves past an orifice. If the squeegee travels too quickly, either no image or a partial image will result on the substrate 32. The orifices 70 behind the squeegee 10, shown to the right in FIG. 6, are partially filled. Depending on the tension of the screen fabric 64, the type of ink 72 used, and the squeegee force and speed, the orifices could be either empty or only partially empty after any given print stroke.

While the applicant does not wish to be bound to any one theory of screening printing operation, it is believed that for optimal screen printing efficiency, the blade 10 should be buckled near the printing edge 20 which allows the interfacial pressure between the squeegee blade 10 and the screen mesh 64 to maximize the shearing force (blade velocity/buckled area of the blade that comes into contact with the ink) and maximize the shear stress (force/area on the fluid) due to the creation of sufficient fluid pressure on the ink. This high fluid pressure reduces the viscosity and surface tension of the ink to an extent that the ink can then flow through the screen mesh and onto the substrate 32 at or near its inherent maximum flow rate during a print stroke. The inks used for screen printing have varying material properties and viscosities and other theological characteristics. However, many commercially available inks typically have a consistency ranging from that of warm molasses to that of cream cheese. Therefore, the ink does not flow into the very small orifices of the screen very easily until the squeegee blade contacts the inks during a print stroke. Most inks with after deposition by a flood bar will tend to stay on top of the screen and only partially, if at all, fill the orifices. Such screen printing inks are often referred to as "shear thinning" inks since under the shearing force created during the screen printing process their viscosity and surface tension significantly decrease.

The curvature of the buckled blade 10 while in contact with the screen mesh 64 and ink 72 forms a divergent flow path for the ink, which raises its fluid pressure and reduces the viscosity of the ink. In response to the increased fluid pressure, the ink 72 flows into and through orifices 70. To optimize efficiency, the downward force on the squeegee blade 10 should be just sufficient to overcome the resistance of the screen tension of the mesh of the screen at any given point along the blade, thereby causing its downward deformation, which forms a brief temporary seal between the printing edge 20 of the blade 10, the mesh 64, ink 72, stencil 66, and the substrate 32. Optimally, the mesh interface (contact area between the printing edge 20 and mesh 64) is just greater than the dimension of one mesh count (distance between adjacent mesh threads in the direction of the print stroke). An overly large mesh interface causes excessive ink flow, which increases the likelihood of positive mesh lag, which can greatly diminish print quality. Positive mesh lag occurs when the mesh of the screen remains in contact with the substrate for too long a period of time after the squeegee blade has moved over a given point on the mesh during a print stroke. Positive mesh lag typically result in dot gain, mottling and piling of ink on the substrate. On the other hand, negative mesh lag occurs when the mesh interface is either (a) less than one mesh count or (b) if the squeegee blade fails to force the mesh of the screen into a proper sealing relationship with the ink, stencil, and substrate. Negative mesh lag typically results in low ink transfer rates, which can cause faint or streaked printing.

Examining the screen fabric 64 in more detail, the screen fabric 64 is comprised of a series of threads 74 running in two directions perpendicular to each other. The threads 74 form openings or orifices 70 in the screen fabric 64. In order to appreciate what the flood bar 10 has to accomplish in filling the orifices, the size of the orifices in a typical screen fabric 64 will be examined. In a conventional mesh screen fabric having a thread diameter after weaving of approximately 47 microns at 0 Newtons/centimeter, there are 93,025 orifices in a square inch since there are 305 threads per inch. Each of the orifices is typically approximately 0.00172 inches by 0.00172 inches in size.

The dual printing edges 20 and 22 have been optimized for different printing functions and inks of higher or lower viscosities. Of course, the blade 10 may be mounted in a manner in which the second printing edge 22 is made to contact the mesh 64. The beveled printing edge 22 is design for use with more viscous printing inks such a white base coat of printing ink often utilized when printing on dark T-shirts or other substrates. The beveled printing edge 22 is also useful where a printer is utilizing a somewhat less viscous ink, but is placing an emphasis on quick ink coverage of a relative large area of a substrate without particular concern over fine print detail. Where beveled printing edge is to be utilized, the blade is mounted into the blade holder such that the beveled leads in the direction of squeegee travel during a print stroke. When fine detail printing is required or where more precise control of the volume of ink passing onto the substrate is desired, the substantially vertical printing edge 20 will typically be selected by the printer during set up for a print job.

Another advantage of the improved squeegee blades of the present invention is that they reduce the problem of "ink build-up." This is the accumulation of "dry sticky" ink on the underside of a screen during wet-on-wet, T-shirt printing. Such ink build up results from a solid-liquid phase separation in the ink triggered by one of three conditions during a printing job: (1) local excesses in hydraulic pressure during a print stroke, (2) ink absorption by the screen over many print stokes, or (3) thermal extremes on the press. If build up on the screen is worse at the perimeter of the screen it is typically due to excess hydraulic pressure at the periphery of the screen cause by uneven blade buckling due to differential tension in the screen. If the build up is in the central area of the screen, it is typically due to excess absorption of ink by the screen, which is due to the uneven squeegee blade buckling failing to provide sufficient ink scraping action across the top of the mesh during each print stroke in a print job. If the build up is consistently bad from central portion of the screen out to the perimeter, it typically is cause by excess deposit of phase unstable inks at the periphery of the screen due to excessive squeegee buckling, which is made worse by elevated temperature along the periphery of the press. The improved squeegee blade of the present invention have buckle control channels which compensate for differential screen tension during the print stroke. As a result, such blades print faster with substantially less blade holder pressure, which results in the deposit of a more consistent ink film from corner-to-corner of the screen and onto the substrate. Less squeegee pressure means longer stencil life and less excess hydraulic pressure ink build-up. Faster blade holder speed means printing is more profitable and less excess ink absorption type build-up. More consistent ink deposit means faster flashing, cooler flash or both, which reduces excess deposit of phase unstable inks.

The blade 10 is molded from a hard resilient material such as suitable polyurethane resins, preferably either a Methylene di-isocyanate (MdI) or Napthalene di-isocyanate (NdI). While the blades of the present invention may be molded from resilient polymeric resins having a Shore A hardness of between 55 and 95, the preferred blades of the present invention will have a Shore A hardness of about 85 for an MdI blade and about 80 for a NdI blade. In contrast to prior art blades designed, the design of the improved blade 10 allows the use of substantially harder resins which provides the blade with improved abrasion resistance for longer blade life and enhanced chemical stability. With prior art designs, the use of such hard resin material that would result in hinging of the blade near the blade holder. Such hinging has been found to adversely affect screen printing efficiency in the printing of for example, T-shirts and graphic art materials. Preferably, the blade 10 is injection molded by a conventional process utilizing MdI resin for blades intended for T-shirt printing. For graphic printing work, UV curable inks, often used for printing on acrylic, polycarbonate, polystyrene, polyester and polyolefin substrates, are sufficiently chemically reactive that the more chemically stable NdI resin is preferred for molding the blade 110 (see FIG. 7). The buckle control channel is preferably formed by means of a CNC blade cutting tool. However, a router type, radiused cutting tool may also be used where the resin selected will not become so roughened that it is difficult to remove ink from the surface of the control channel 28. It has been found that 2 overlapping passes with either blade cutting tool or a radiused cutting tool is the most efficient way to form the buckle control channel in the blades of the invention. However, for certain blades/control channel design one pass cutting may be more efficient. Furthermore, it contemplated that the buckle control channel could be molded into the blades of the invention by use of a suitable side-action tool to accommodate the undercut represented by such a channel. The bull nose corner portions 38 and beveled portion 25 are also preferable formed by use of a cutting tool after injection molding.

Larger screen printing presses, they may be fitted with either 18 or 20 inch squeegee blades or their metric equivalent. When such larger blade is blades are needed for T-shirt printing job, 18 inch or 20 inch blades similar in most respects to blade 10 shown in FIGS. 1-6 are be preferred. However, such 18 or 20 inch long blades would have a slightly larger radius of curvature for the buckle control channel with the bottom portion of the channel being positioned approximately ⅜ of an inch above the first printing edge and extending further upward toward both the first and second ends of the blade. At both ends, the bottom most portion of the buckle control channel would preferably be located three quarters an inch from the top surface of the blade. This slightly larger radius of curvature in the 18 and 20 inch blades is provided to accommodate the larger variation in screen tension between the parts adjacent to the screen frame and the center of the enlarged screen of such over-sized screen printing presses.

Figure 7:
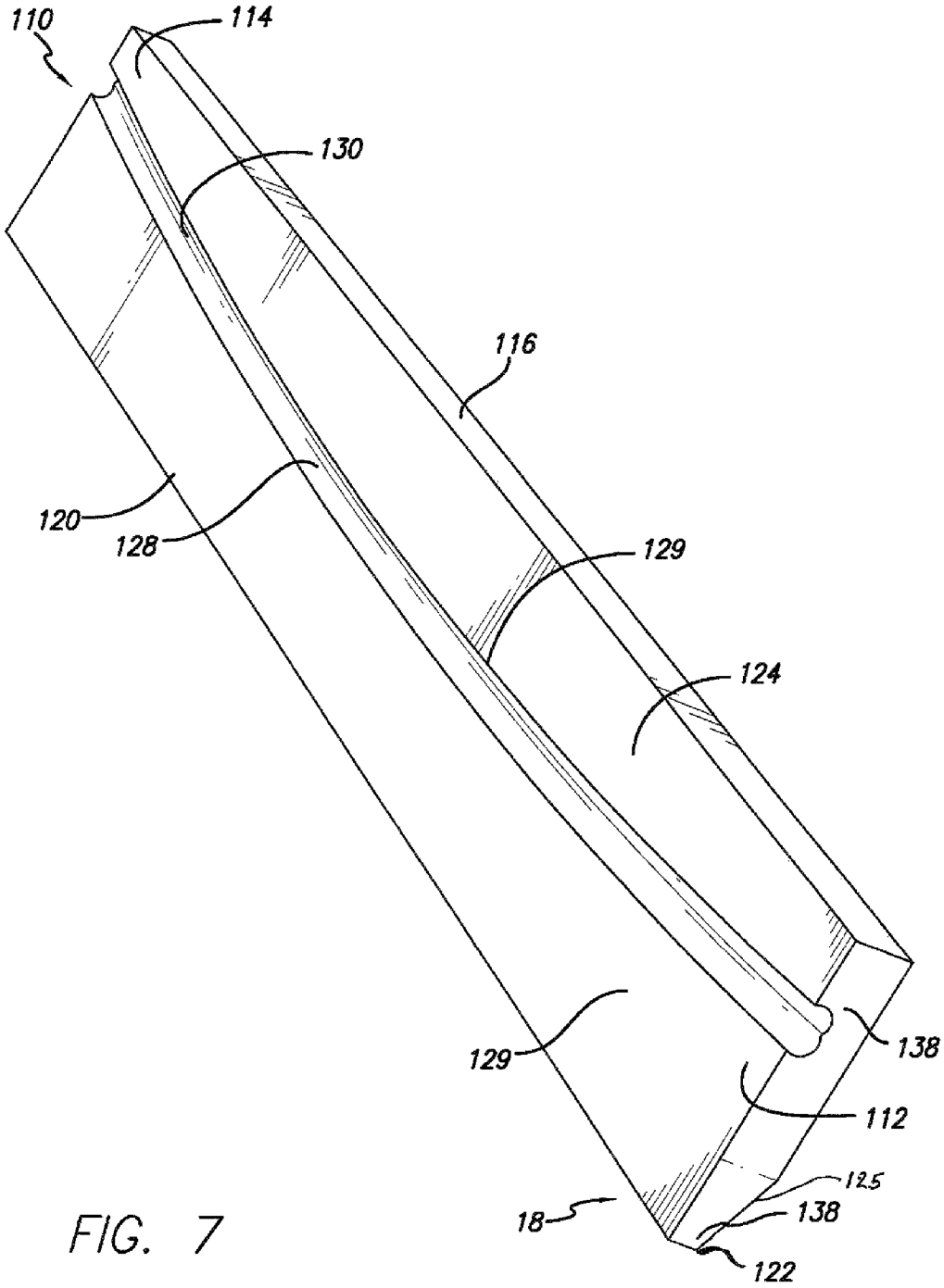
FIG. 7 is a front perspective view showing a squeegee blade in accordance with an alternate embodiment of the invention.

As shown in FIG. 7, another alternate embodiment of the improved squeegee blade of the invention is also illustrated. In this embodiment of the invention, the improved squeegee blade 110 includes a first end 112, a second end 114, a top surface 116 for receipt by a blade holder, a bottom surface 118, a front face 124, a back surface 126, a first printing edge 120 joining the front face 124 and bottom surface 118, a second print edge 122 joining the bottom surface 118 and the beveled lower portion 125 of the back surface 126, bull nose corner portions 138 formed at the periphery of the bottom surface, and a buckle control channel 128 formed in the front face 124. Both printing edges 120 and 122 of blade 110 are adapted for contacting the screen of a screen printing press.

As seen in FIG. 7, blade 110 is similar in many respects to blade 10 with the primary visually apparent difference being that the buckle control channel 128 of blade 110 has been raised substantially away from the first printing edge 120 such that the bottom edge 129 of the buckle control channel 128 is located about ⅝ of an inch from the first printing edge 120 at the central portion of the blade 110 and the top edge 130 is located ⅝ of an inch from the top surface 116. The blade design 110 is preferred for graphics printing or other print jobs that utilize chemically reactive inks, including the UV curable inks typically used to print on acrylic, polycarbonate, polystyrene, polyester and polyolefin substrates. Such chemically aggressive inks typically cause swelling of the printing edges 120, 122 of the blade 110 after repeated uses. Accordingly, it is customary for blades utilized with chemically reactive inks to be trimmed periodically as the printing edge becomes swollen sufficiently to begin to impair print efficiency. This is accomplished by slicing off a thin layer of the bottom surface 118 to remove the swollen portion of the printing edge, which creates a fresh (not swollen) printing edge. Typically, the printer strives to trim off the smallest possible amount of the swollen blade to maximize the number of trimming operations possible during the useful life of a given blade. In practice, this usually means that the bottom 1/16 of an inch of the blade is sliced away in each trimming operation. The placement of the buckle control channel 130 higher up on the front face 124 of the blade 110 is designed to maximize the possible number of trimming operations along the bottom surface 118 of the blade 110 to create new print edges 120, 122. If desired, the back surface of the blade 126 can also be subject to an additional slicing operation to maintain the same geometry of the beveled print edge 122 as prior to the trimming. The top surface 130 of the buckle control channel 128 of blade 110 is preferably mounted adjacent to the bottom edge of the blade holder, which typically is dimensioned to receive the top ⅝ of an inch of a squeegee blade. This means that at its ends 112, 114, the buckle control channel 128 of the blade 110 will be adjacent to the blade holder, but should not be mounted with the buckle control channel under the blade holder. As mentioned above, it preferred that blade 110 be formed from a relatively chemically inert resilient resin, such as NdI. When utilizing NdI resin to form blade 110, it is preferred that the Shore A hardness be 80, but may range from 55 to 95.

Figure 8:
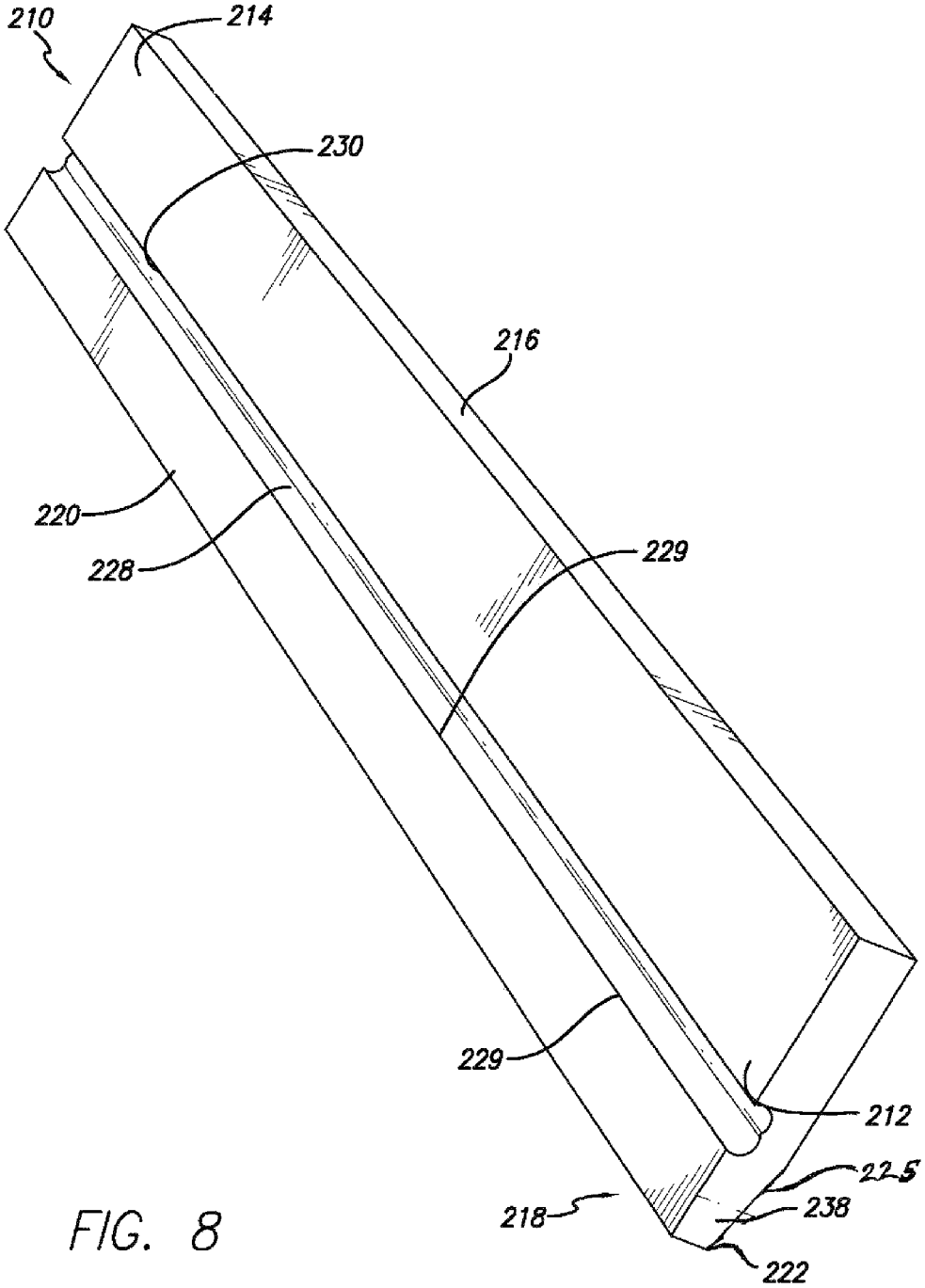
FIG. 8 is a front perspective, illustrating a squeegee blade in accordance with another alternate embodiment of the invention.

FIG. 8 illustrates a still further alternate embodiment of the improved squeegee blade of the invention. In this embodiment of the invention, the improved squeegee blade 210 includes a first end 212, a second end 214, a top surface 216 for receipt by a blade holder, a bottom surface 218, a front face 224, a back surface 226, a first printing edge 220 joining the front face 224 and bottom surface 218, a second print edge 222 joining the bottom surface 218 and back surface 226, bull nose corner portions 238 formed at the periphery of the bottom surface, and a buckle control channel 228 formed in the front face 224. Both printing edges 220 and 222 of blade 210 are adapted for contacting the screen of a screen printing press.

As seen in FIG. 8, blade 210 is similar in many respects to blade 10 with the primary visually apparent difference being that the buckle control channel 228 of blade 210 is substantially linear with the bottom edge 229 of the buckle control channel 228 located about 11/32 of an inch from the first printing edge 220 along the entire length of the blade 210 from first end 212 to second end 214. The blade 210 is designed for the relatively unusual situation wherein the image to be printed is small enough that its edges do not come within 5 inches of any portion of the screen frame (e.g., a less than 8 inch wide image on an 18 inch screen press). Such relatively unusual print jobs occur typically for the printing of paperboard cover for insertion into compact disk (CD) cases or computer disk cases. Blade 210 is shown with the same 16 inch blade dimensions as blade 10 with the exception of the linear buckle control channel 228 and is preferably molded from a MdI resin having a Shore A hardness of 85. However, it is contemplated that for relatively narrow print jobs like CD or computer disk cover printing smaller 8 inch length blades are likely to be offered. The reason the buckle control panel is linear is that the 5 inch distance between the blade and inside of the press frame provides relatively equal screen tension across the length of the blade so that the curvature to compensate for different screen tension is not necessary. The blades of the invention may further include a UV curable version of blade 210 (not shown), which would be similar in all respects to blade 210 expect that it would be formed from a more chemically stable NdI resin with a preferred Shore A hardness of 80 and the top edge of its substantially linear buckle control channel would be located just over ⅝ of an inch from the top surface of the blade. This buckle control channel arrangement would allow for maximum blade trimming as descried above with regard to blade 110. Such UV ink stable, substantially linear buckle control channel blade would be useful, for example, for the printing of narrow print jobs for which UV curable inks have been selected.

The present inventor has further discovered that the improved squeegee blade designs of the invention allow the screen printing press to be set up with significantly lower downward pressure on the squeegee blade, substantially more vertical blade angle, and significantly higher blade holder speeds than is typically utilized for conventional squeegee blades. Conventional screen press set up parameters for T-shirt printing with prior art blades include a downward blade holder pressure of about 80 psi with a initial blade angle laid over from the vertical at an angle of between 10 to 15 degrees from vertical. The laid over blade angle and increased downward pressure on the blade are necessary to compensate for the differential tension across the screen in order for the low tension, central portion of the screen to cause the central portion of the conventional squeegee blade to buckle sufficiently to allow enough buckling for acceptable quality printing. However, these same parameters cause excessive buckling of the conventional blades on the peripheral portions of the conventional blade which are located within five inches of the inside of the press frame. This typically causes uneven printing with more ink flowing onto the substrate along the printed image substrate than in the image central portion. Accordingly, conventional blade set up is often becomes a trial and error balancing act in which the printer attempts to find a slow enough print speed, laid over initial blade angle and high enough downward blade pressure to print with acceptable image quality on both the center and periphery of the image for each new print job. However, these attempts to compensate for uneven buckling of the squeegee blade by adjusting press set up parameters are usually only partially successful since image quality and print job efficiency is often far less than optimal for a given job.

With the blades of the present invention, typical T-shirt printing press parameters are a downward blade holder pressure of between 30 and 40 psi, an initial blade angle of between about 2 and 10 degrees from vertical, and blade holder speeds of from about 10 inches per second (ips) to 25 ips. The improved blades of the present invention provide a consistent, optimized blade buckle shape along the length of the blade during a print stroke due to its inclusion of a buckle controlled channel appropriate for a given print job. Where the image to be printed has a width that is within ten inches (five inches on each side) of the width of the inside of the printing press frame, the printer will choose to use improved squeegee blade designs of the present invention having curved (or elliptical) buckle control channels, such as, e.g., blades 10 (or 110 if UV curable inks are to be utilized). This allows the operator to consistently utilize more efficient press set up parameters for a given job. This results the ability to use significantly higher blade holder speeds for a given printing job while producing printed images on the substrate of equal or superior print quality than is possible when using conventional press set up parameters and conventional squeegee blades for such a job. The use of lower downward blade holder pressure also provide the benefit of decreasing wear on the squeegee blade, the screen mesh, stencil and other screen printing press components.

Figure 9:
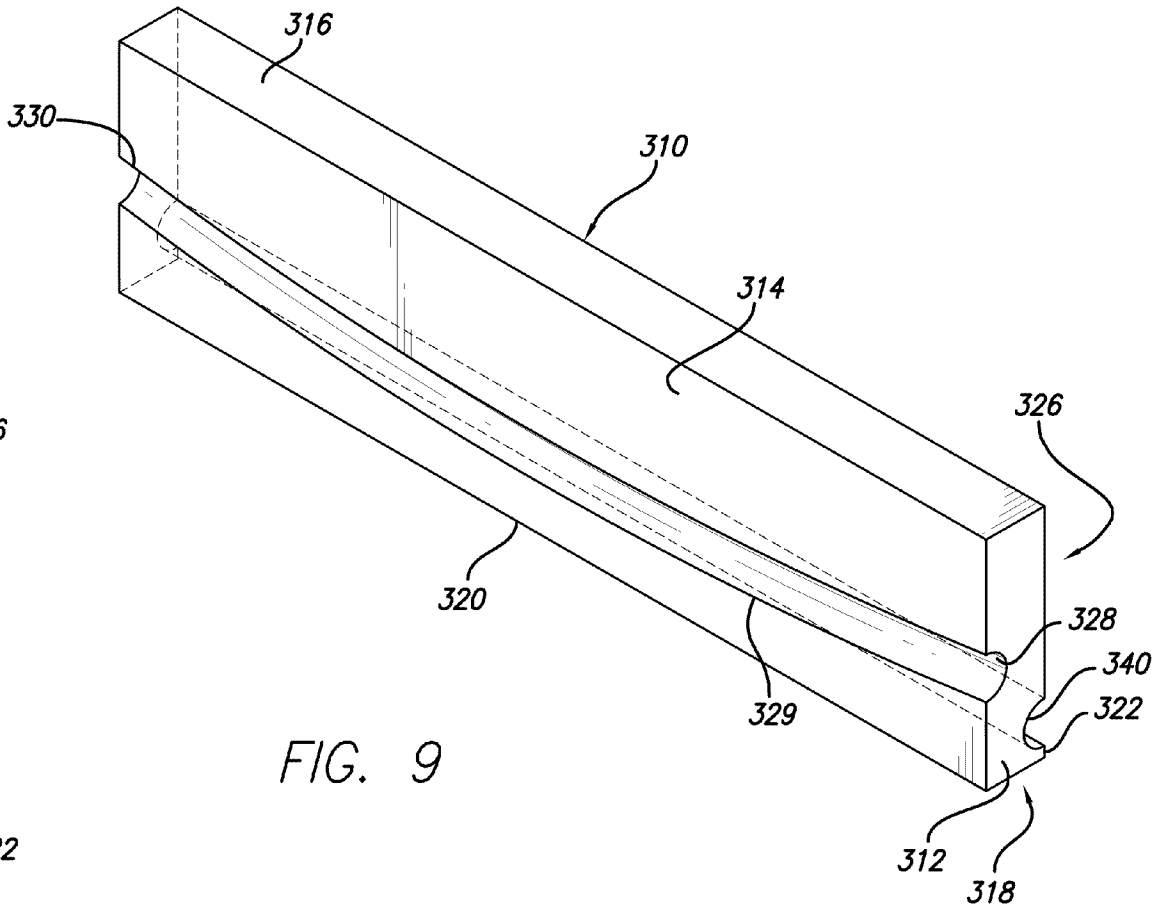
FIG. 9 is a front perspective view of another alternate embodiment of a squeegee blade of the invention.
Figure 10:
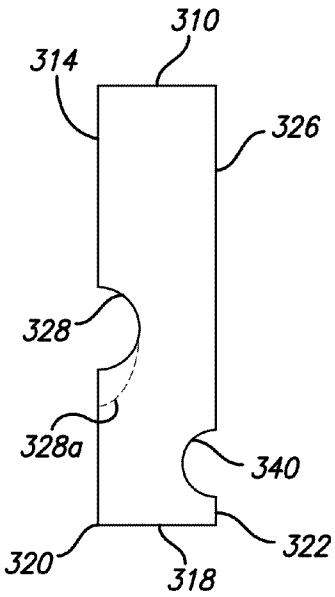
FIG. 10 is an end plan view of the squeegee blade of FIG. 9.

FIGS. 9 and 10 illustrate another alternate embodiment of the squeegee blade of the invention. In this embodiment of the invention, the improved squeegee blade 310 includes a first end 312, a second end 314, a top surface 316 for receipt by a blade holder, a bottom surface 318, a front face 324, a back surface 326, a first printing edge 320 joining the front face 324 and bottom surface 318, a second print edge 322 joining the bottom surface 318 and back surface 326, and a buckle control channel 328 formed in the front face 324. The blade 310 further includes a second, linear buckle control channel 340 located adjacent to the print edge 322. Linear buckle control channel 340 is shown in dashed lines in FIG. 9. The channel of curved buckle control channel 328 on the front face of the blade preferably has a significantly larger radius of curvature than linear buckle control channel 340 on the back surface 326 adjacent to the print edge 322 and near the bottom surface 318 of the blade 310. The difference in radius of curvature is preferably on the order of about 40%.

Both printing edges 320 and 322 of blade 310 are adapted for contacting the screen of a screen printing press. However, print edge 322 is designed for depositing an especially thick, uniform layer of ink on the printing substrate which is useful for precision printing application such as the printing of membrane switches and high quality graphics materials. The print edge 322 provides a substantially uniform ink film with a thickness of between about 1.25 and about 1.35 thousandths of an inch on a 305 thread per inch mesh with a thread thickness of 35 microns per thread. Significantly, such a mesh is nominally rated for a maximum ink film thickness with conventional prior art blades at 1.0 thousandths of an inch. In precision applications, where opacity and pin hole quality control are critical, the thicker more uniform ink film deposited when screen printing with the print edge 322 of improved blade 310 offers a significant improvement over prior art blades, which often suffered from opacity and pin hole quality control issues due to the thinner, less uniform layer of ink they typically deposit. Furthermore, the applicant has found that printing jobs utilizing the print edge 322 of the blade 310 not only can print a thicker, more uniform layer of ink on a substrate, but that the print jobs can be run as higher speeds with typical print speeds of at least 20 inches per second (about 500 mm per second) and in some cases up to about 30 inches per second (about 760 mm per second). These print speeds with print edge 322 are two to three times faster than the conventional speeds of about 10 inches per second with higher print quality print output. The printing edge 320 of blade 310 provides a substrate film thickness between about 0.65 and 0.75 thousandths of an inch.

As seen in FIGS. 9 and 10, blade 310 can be utilized to great effect in printing precision graphics printing, printing membrane switches. Such print jobs frequently utilize relatively viscous and/or chemically reactive inks, including the UV curable inks typically used to print on acrylic, polycarbonate, polystyrene, polyester and polyolefin substrates. Membrane switches often utilize conductive silver inks that have the consistency of a thick paste and are relatively chemically reactive. Such chemically aggressive inks typically can cause swelling of the printing edges 320, 322 of the blade 310 after repeated uses. Accordingly, it is customary for blades utilized with chemically reactive inks to be trimmed periodically as the printing edge becomes swollen sufficiently to begin to impair print efficiency. This is accomplished by slicing off a thin layer of the bottom surface 318 to remove the swollen portion of the printing edge, which creates a fresh (not swollen) printing edge. Typically, the printer strives to trim off the smallest possible amount of the swollen blade to maximize the number of trimming operations possible during the useful life of a given blade. Since it will be used primarily with chemically reactive inks, it preferred that blade 310 be formed from a relatively chemically inert resilient resin, such as NdI. When utilizing NdI resin to form blade 110, it is preferred that the Shore A hardness be 80 to increase the durability and chemical resistance of the blade, but the Shore A hardness may range from 55 to 95 for blade 310 depending upon the type of intended print job for which it is intended.

In a further preferred aspect of the invention, the applicant has developed at least three additional blade print edge/curved buckle control channel configurations (shown in FIGS. 11, 13 and 14), which yield different printed ink film thicknesses on a substrate for each of the two printing edges of the blade. Furthermore, applicant has found that it is often advantageous for the printer to have each of the two printing edges on a single blade provide significantly different, but consistent ink film thicknesses in order to allow the printer the flexibility to select a specific print edge of one of the five blade iteration to match a precision printing specification for ink film thicknesses. Moreover, by utilizing a number of different of the improved blades of the present invention with different printing edge/buckle control panel combinations a screen printer can ensure that virtually any ink film thickness specification for a given mesh can be met within a range of about minus 45 percent to about plus 35 percent of the nominal maximum ink thickness rating of a mesh. In contrast, prior art blades typically yield inconsistent ink film thickness, which an average thickness of about 90% of the nominal maximum thickness for a given screen mesh.

Figures 11, 12, 13, 14:
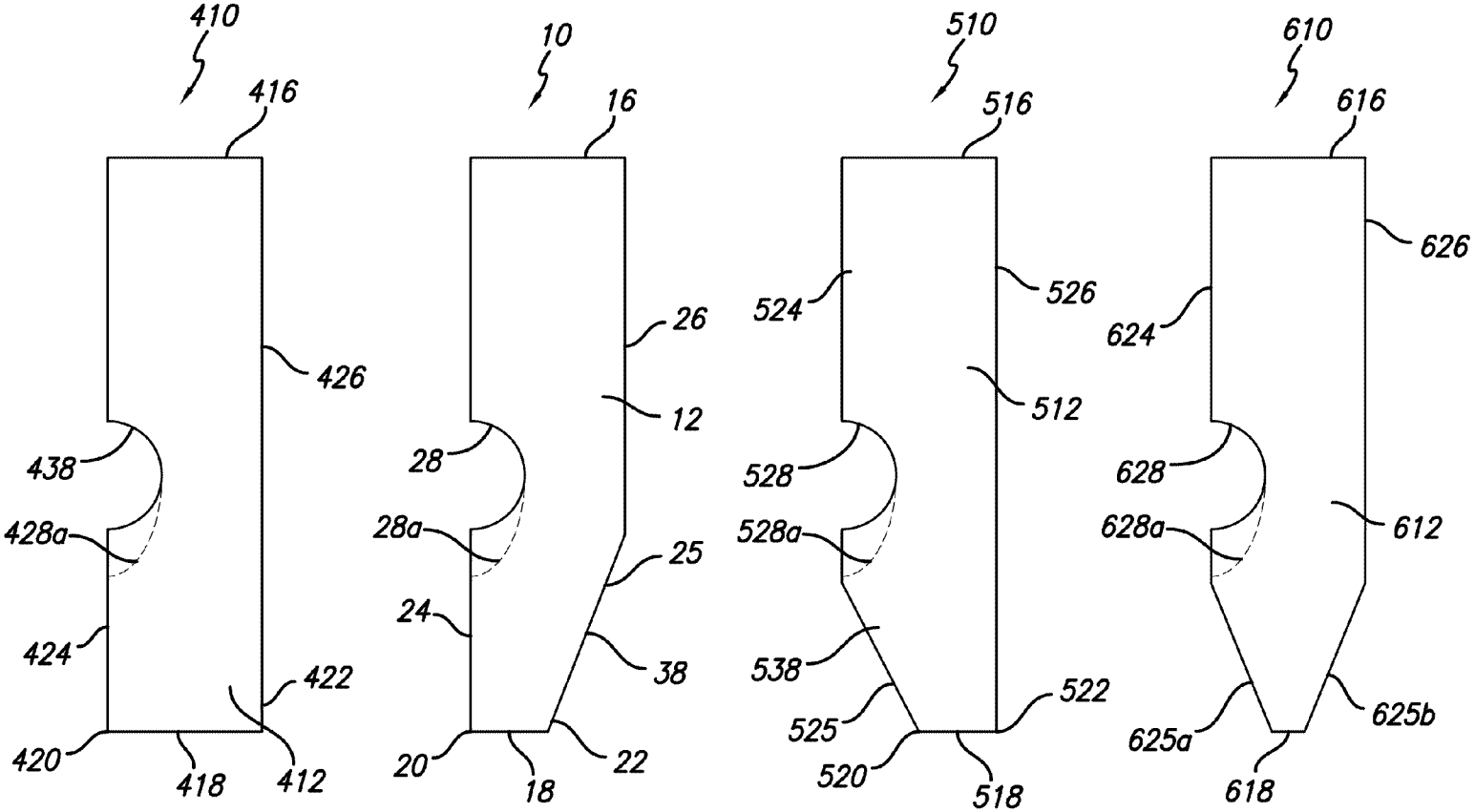
FIG. 11 is an end plan view of another alternate embodiment of the squeegee blade of the invention.
FIG. 12 is an end plan view of a of the squeegee blade of FIG. 1.
FIG. 13 is an end plan view of another alternate embodiment of the squeegee blade of the invention.
FIG. 14 is an end plan view of another alternate embodiment of the squeegee blade of the invention.

FIG. 11 illustrates another additional embodiment of the invention, in which squeegee blade 410 includes a first end 412, a second end (not shown), a top surface 416 for receipt by a blade holder, a bottom surface 418, a front face 424, a back surface 426, a first printing edge 420 joining the front face 424 and bottom surface 418, a second print edge 422 joining the bottom surface 418 and back surface 426, and a curved buckle control channel 428 formed in the front face 424. The extent of curvature of the buckle control channel 428 of the blade 410 is indicated by phantom lines 428(*a*) which show the dip in the channel near the control portion of the blade 410. Blade 410 can be set up in a printing press for precision printing to provide ink film thicknesses of between about 0.55 to about 0.70 thousandths for front face print edge 420 and between about 0.75 to about 0.85 thousandths for back side print edge 422. The blade hard 410 can be formed from resilient material such as suitable polyurethane resins, preferably either MdI or NdI. With MdI being preferred for use with non-chemically reactive inks and NdI being preferred for chemically reactive inks. The blades 410, 510 and 610 may be molded from resilient polymeric resins having a Shore A hardness of between 55 and 95, but a Shore A hardness of about 85 for an MdI blade and about 80 for a NdI blade are preferred for increased abrasion resistance and chemical stability.

FIG. 12 illustrates the blade 10 of FIGS. 1-6 shown in end plan view to show it comparison to similar alternate curved channel/printing edge iterations of the squeegee blade of the present invention.

FIG. 13 illustrates another additional embodiment of the invention, in which squeegee blade 510 includes a first end 512, a second end (not shown), a top surface 516 for receipt by a blade holder, a bottom surface 518, a front face 524, a back surface 526, a first printing edge 520 joining a lower beveled portion 525 of the front face 524 and bottom surface 518, a second print edge 522 joining the bottom surface 518 and back surface 526, and a curved buckle control channel 528 (with the extent of curvature shown b phantom lines 528*a*) formed in the front face 524. Blade 510 can be set up in a mechanical printing press for precision printing to provide ink film thicknesses of between about 0.75 to about 0.85 thousandths for front face print edge 520 and between about 0.55 to about 0.65 thousandths for back side print edge 522. The blade hard 410 can be formed from resilient material such as suitable polyurethane resins, preferably either MdI or NdI. With MdI being preferred for use with non-chemically reactive inks and NdI being preferred for chemically reactive inks.

FIG. 14 illustrates another additional embodiment of the invention, in which squeegee blade 610 includes a first end 612, a second end (not shown), a top surface 616 for receipt by a blade holder, a bottom surface 618, a front face 624, a back surface 626, a first printing edge 620 joining a lower beveled portion 625*a* of the front face 624 and bottom surface 618, a second print edge 622 joining the bottom surface 618 and a lower beveled portion 625*b* of the back surface 626, and a curved buckle control channel 628 (with extent of curvature shown by phantom line 628*a*) formed in the front face 624. Blade 610 can be set up in a printing press for precision printing to provide ink film thicknesses of between about 1.05 to about 1.15 thousandths for front face print edge 620 and between about 0.95 to about 1.05 thousandths for back side print edge 622.

An improved method of screen printing is provided, which may include the first step of choosing an appropriate squeegee blade for a given printing project. For a printing job in which the image to be printed on the substrate with a width that is within ten inches (five inches on each side) of the width of the inside of the press frame, the printer will choose to use either squeegee blade 10, 110, 310, 410, 510, or 610 (if UV curable inks are to be utilized, blades 10, 310 or 610 are typically preferred). If the width of the image to be printed is less than the standard 16 inch length of blades 10,110, 310, 410, 510, or 610, but still within 10 inches of the width of the inside of the press frame, both ends of the selected blade 10, 110, 310, 410, 510, or 610 can be trimmed to be just longer than the width of the image. This process of trimming form both ends will ensure that the trimmed blade will maintain its pressure compensation characteristics during a print stroke. On the other hand, if the image to be printed is 10 inches narrower than that inside of the press frame, then a linear buckle control blade 210 (or its UV curable variant) may be selected for the print job.

Next one of the two printing edges of a given blade that are appropriate for a print job (or portion of a print job) should be selected, that is, either perpendicular or flat print edge (20, 120, 220, 320, 322, 420, 422 or 522) or beveled print edge (22, 122, 222, 522, 620 and 622). The flat edged are used when a thinner ink deposit is desired, when finer print details are specified (e.g., half tone printing), or when dark ink are to be printed on a lighter background. The beveled edges are used where increased fluid pressure on the ink is desired such as when thicker ink film coverage is specified (e.g., base coatings), printing with opaque colors, printing with many white (highly viscous) inks, printing with other high density inks, metallic inks or many viscous special effect colors. After the appropriate printing edge is selected, the blade is mounted in the blade holder in a substantially conventional manner, expect that care should be taken that the buckle control channel is installed in the appropriate orientation, that is, bull nosed corners down and curvature of the buckle control channel (if any, in the selected blade) pointing up. Further, it is best if the blade is mounted so that no portion of the buckle control channel is within the confines of the blade holder as this may cause uncontrolled leaking or caking of ink within the holder during a printing operation. After mounting the blade, the initial blade angle is set between about 2 and 10 degrees from vertical, preferably between 3 and 5 degrees from vertical when printing on T-shirts. This is substantially more vertical than typical with conventional squeegee blades, which are typically laid over between 10 and 15 degrees from vertical. Then, the downward pressure on the blade holder is set. For most inks utilized in T-shirt printing jobs having moderate viscosities, the pressure may be set as low as 30 psi. For more viscous inks, such as dilatent white inks, high yield stress colored inks or silver conductive inks, the blade holder pressure will be set at abut 40 psi. These downward pressure settings correspond to roughly to a downward squeegee blade pressure of less than about 40 $N/cm^2$ when measured at the screen. This downward pressure will preferably be set to nearly match the actual screen tension in the central portion of the screen. The downward blade holder pressure settings with the improved blades of the invention are significantly lower than is typical with comparable print jobs for conventional squeegee blades in which downward blade holder pressure is typically between about 40 psi and about 100 psi. Next, the blade holder speed is set. For the most T-shirt printing inks, the blade holder speed can be set in the range of from about 5 ips to about 25 ips, preferably between about 15 ips and about 25 ips when printing on T-shirts. This is typically between about 25% and about 50% higher than the blade holder speeds which would be set for a comparable print job with a conventional squeegee blade. In precision graphics printing and membrane switch printing with high viscosity inks, applicant has achieved print speeds as high as 30 ips utilizing the blades of the invention with excellent ink film thickness consistency and no significant pin hole quality issues.

Thereafter, the automatic screen printing press is activated to print on the selected substrate. This will cause a flood bar (or doctor blade bar) to spread ink evenly onto the screen above the substrate. The improved squeegee blade of the invention then moves across the printing press screen in the Y-axis causing the blade to buckle near the selected printing edge (20, 120, 220, 320, 322, 420, 422, 522, or 22, 122, 222, 522, 620, 622), which allows the interfacial pressure between the squeegee blade and the screen mesh to maximize the shearing force (blade velocity/buckled area of the blade that comes into contact with the ink) and maximize the shear stress (force/area on the fluid) due to the creation of sufficient fluid pressure on the ink. This high fluid pressure reduces the viscosity and surface tension of the ink to an extent that the ink can then flow through the screen mesh and onto the substrate at or near its inherent maximum flow rate during a print stroke. In response to the increased fluid pressure, the ink flows into and through orifices of the mesh of the screen. The downward force on the squeegee blade is preferably set to be just sufficient to overcome the resistance of the screen tension of the mesh of the screen at any given point along the blade, thereby causing its downward deformation, which forms a brief temporary seal between the printing edge of the blade, the mesh, ink, stencil, and the substrate. The controlled buckling of the improved blades of the invention cause the blade to maintain a mesh interface (contact area between the printing edge and mesh) that is just greater than the dimension of one mesh count (distance between adjacent mesh threads in the direction of the print stroke). As the squeegee blade continues to move over the screen fabric deflecting the screen into new mesh interface line along the Y-axis of the screen, the line of screen fabric just behind the squeegee blade snaps upward away from the substrate, which further assists in drawing the ink through the orifices of the screen mesh and onto the substrate. After the squeegee blade finishes is travel along the Y-axis of the printing press screen, a print stroke is completed. The process is then repeated as needed for a print job. Of course, the blade can be removed, turned around and remounted with the non-selected printing edge arranged to contact the mesh to print another portion of the same print job or to print in an entirely different print job.

The invention claimed is:

1. An improved screen printing squeegee blade for use in a mechanical screen printing press for applying ink to a substrate during a printing stroke, comprising: a blade body having a first end, a second end, a top portion spaced apart from a screen of the mechanical screen printing press, a bottom portion adapted for contacting the screen of the mechanical screen printing press along at least one printing edge, a front face, a back surface, and a buckle control channel formed in one of the front face and the back surface of the blade, the buckle control channel being spaced apart from the at least one printing edge a sufficient distance that the buckle control channel hinges horizontally along the length of the blade above the zone of contact between the blade and the ink during a printing stroke, wherein the buckle control channel is curved along its length, the curved buckle control channel defines a channel formed in one of the front face and back surface of the squeegee blade, the curved buckle control channel extends from the first end to the second end of the blade in an arc with the channel extending closer to the bottom portion of the blade in the center portion of the blade than at the first end and second end of the blade.

2. The improved screen printing squeegee blade of claim 1 wherein the curved buckle control channel is dimensioned to act as a hinge along the length of the blade to provide a substantially uniform, linear buckling front along the length of the squeegee blade from the first end to the second end of the blade to provide controlled buckling of the blade adjacent to at least one printing edge of the squeegee blade during a print stroke.

3. The improved screen printing squeegee blade of claim 1 wherein the curvature of the buckle control channel and the dimensions of the buckle control panel are selected to regulate buckling of the blade between the center portion and the first and second ends in order to accommodate significant screen printing tension differentials between the center portion of the screen and at the edges of the screen adjacent a frame in order to maintain a substantially linear printing edge along the length of the blade during a print stroke.

4. The improved screen printing squeegee blade of claim 1 wherein the curved buckle control channel is formed by cutting a pair of elongated radially overlapping channels into one of the front face and the back surface of the blade.

5. The improved screen printing squeegee blade of claim 1 wherein the curved buckle control channel includes an upper channel side wall and a lower channel side wall, a channel bottom portion, and an accurate channel transition portion extending between the channel side walls and channel bottom portion.

6. The improved screen printing squeegee blade of claim 1 wherein the curved buckle control channel is about seventy percent wider as measured between the channel side walls at both the first end of the blade and the second end of the blade than in the middle of the blade.

7. The improved screen printing squeegee blade of claim 1 wherein the blade is molded from a plastic resin having a Shore A hardness of greater than about 55.

8. The improved screen printing squeegee blade of claim 1 wherein the curved buckle control channel forms a parabolic path with the upper side wall located at between thirty to about seventy percent of the distance between top and bottom edges of the blade at both the first end and the second end of the blade and the buckle control channel arcing toward the bottom edge of the blade so that the upper side wall is located at a height of between about fifteen and about 60 percent of the distance between the top and bottom edge in the center portion of the blade.

9. The improved screen printing squeegee blade of claim 1 wherein a substantially perpendicular transition between the bottom portion and one of the front face and back surface of the blade defines a first substantially perpendicular print edge of the blade and wherein a second, substantially beveled transition between the bottom portion and the other of the front face and the back surface of the improved squeegee blade defines a second beveled print edge of the blade.

10. The improved screen printing squeegee blade of claim 1 wherein a first, substantially beveled transition between the bottom portion and the front face of the blade defines a first beveled print edge of the blade and wherein a second, substantially beveled transition between the bottom portion and the back surface of the blade defines a second beveled print edge of the blade.

11. The improved screen printing squeegee blade of claim 1 wherein a linear buckle control channel is formed in one of the face and back surface of the blade and extends substantially linearly from the first end of the blade to the second end of the blade and wherein the linear buckle control channel extends along the length of the blade adjacent to the bottom portion of the blade.

12. The improved screen printing squeegee blade of claim 11 wherein the blade further includes a linear buckle control channel which extends along the length of the blade closer to the bottom portion of the blade than the curved buckle control channel.

13. The improved screen printing squeegee blade of claim 12 wherein the linear buckle control channel is formed in back surface of the blade and extends substantially linearly from the first end to the second end of the blade along the length of the blade adjacent to the bottom portion and wherein a perpendicular transition between the bottom portion and the back surface of the blade defines a substantially perpendicular back, print edge of the blade, wherein the back print edge of the blade prints a uniform layer of ink with a thickness of greater than 1.2 thousandths of an inch on a 305 thread per inch mesh with a mesh thread thickness of 0.035 microns, which mesh is normally rated for print thickness of 1.0 thousandths of an inch.

14. The improved screen printing squeegee blade of claim 12 wherein the blade body is formed from a plastic resin having a Shore A hardness of greater than about 80.

15. The improved screen printing squeegee blade of claim 12 wherein the dimensions and placement of one or more curved buckle control channels relative to the contours, dimensions and placement of each of two printing edges are selected to deliver a significantly different predetermined print film thickness on each of a first and second print edges.

16. The improved screen printing squeegee blade of claim 1 wherein the dimensions of the curved buckle control channel are selected so that the blade may be set up to print in a mechanical screen printing press with an initial blade angle of less than about 7 degrees from perpendicular with the screen of the printing press.

17. The improved screen printing squeegee blade of claim 1 wherein the dimensions of the curved buckle control channel are selected so that the blade may be set up to print in a mechanical screen printing press with an initial blade angle of between about three and about five degrees from perpendicular with the screen of the printing press.

18. The improved screen printing squeegee blade of claim 1 wherein a substantially perpendicular transition between the bottom portion and the front face of the blade defines a first substantially perpendicular print edge of the blade and wherein a substantially perpendicular transition between the bottom portion and the back surface of the blade defines a second substantially perpendicular print edge of the blade.

19. The improved screen printing squeegee blade of claim 1 wherein the blade body has the curved buckle control channel, dimensioned to accommodate a screen tension differential between the screen of the mechanical printing press screen adjacent to a screen frame and the central portion of the screen mesh such that the blade maintains a linear print front along its length as the blade travels at print speeds of at least about 500 mm per second wherein a mechanical screen printing press can operate during a print run at speeds of greater than about 500 mm per minute with excellent print quality.

20. An improved screen printing squeegee blade for use in a mechanical screen printing press for applying ink to a substrate during a printing stroke, comprising: a blade body having a first end, a second end, a top portion spaced apart from a screen of the mechanical screen printing press, a bottom portion for contacting the screen of the mechanical screen printing press along at least one printing edge, a front face, a back surface, and a buckle control channel formed in the front face of the blade, the buckle control channel extends from the first end to the second end of the blade in an arc with the channel extending closer to the bottom portion of the blade in the center portion of the blade than at the first end and second end of the blade, and a substantially beveled transition between the bottom portion and the front face of the blade defines a beveled print edge of the blade for high speed application of controlled quantities of ink for fine detail printing.

21. An improved screen printing squeegee blade for use in a mechanical screen printing press comprising: a blade body having a first end, a second end, a top portion for receipt by a blade holder of the mechanical screen printing press, a bottom portion adapted for contacting a screen of the mechanical screen printing press along at least one printing edge, a front face, a back surface, and a buckle control channel formed in one of the front face and the back surface of the blade, wherein the buckle control channel is curved along its length, the curved buckle control channel defines a channel formed in one of the front face and back surface of the squeegee blade, the curved buckle control channel extends from the first end to the second end of the blade in an arc with the channel extending closer to the bottom portion of the blade in the center portion of the blade than at the first end and second end of the blade.

* * * * *